US009226561B2

(12) United States Patent
Arney

(10) Patent No.: US 9,226,561 B2
(45) Date of Patent: Jan. 5, 2016

(54) BOTTLE WITH APPLICATOR

(71) Applicant: Michelle Arney, San Francisco, CA (US)

(72) Inventor: Michelle Arney, San Francisco, CA (US)

(73) Assignee: Smart Assets, Inc., San Francisco, CA (US)

( * ) Notice: Subject to any disclaimer, the term of this patent is extended or adjusted under 35 U.S.C. 154(b) by 0 days.

(21) Appl. No.: 14/300,186

(22) Filed: Jun. 9, 2014

(65) Prior Publication Data

US 2014/0286688 A1 Sep. 25, 2014

Related U.S. Application Data

(63) Continuation of application No. 13/763,237, filed on Feb. 8, 2013, now Pat. No. 8,783,990.

(51) Int. Cl.

| | |
|---|---|
| ***A45D 34/04*** | (2006.01) |
| ***B65D 1/02*** | (2006.01) |
| ***A45D 29/12*** | (2006.01) |
| ***A45D 40/26*** | (2006.01) |
| ***B65D 51/32*** | (2006.01) |

(52) U.S. Cl.

CPC ..... *A45D 29/12* (2013.01); *A45D 40/264* (2013.01); *A45D 40/265* (2013.01); *B65D 1/0261* (2013.01); *B65D 51/32* (2013.01); *A45D 34/045* (2013.01); *A45D 2200/05* (2013.01)

(58) Field of Classification Search

USPC ..... 401/121, 122, 126–130

See application file for complete search history.

(56) References Cited

U.S. PATENT DOCUMENTS

| | | | | |
|---|---|---|---|---|
| 63,841 | A * | 4/1867 | Bly | 15/257.05 |
| 2,135,239 | A | 11/1938 | Patterson | |
| 2,865,384 | A | 12/1958 | Noon | |
| 5,116,154 | A | 5/1992 | Fulkerson | |
| D387,909 | S | 12/1997 | Mattson | |
| 6,158,912 | A | 12/2000 | Miraglia | |
| 6,164,857 | A | 12/2000 | Wolfarth-Brooks | |
| D439,010 | S | 3/2001 | Sogaro | |
| D480,647 | S | 10/2003 | Crawford | |
| 6,632,040 | B1 * | 10/2003 | Newell | 401/129 |
| 6,872,020 | B2 | 3/2005 | Epli | |
| D505,863 | S | 6/2005 | Crawford | |
| 7,044,670 | B2 * | 5/2006 | Delage | 401/127 |
| 7,144,172 | B2 * | 12/2006 | Zhadanov et al. | 401/127 |
| D550,083 | S | 9/2007 | Etheridge | |
| 8,342,321 | B2 * | 1/2013 | McAllan | 206/15.3 |
| 2003/0147685 | A1 * | 8/2003 | Epli | 401/127 |

* cited by examiner

*Primary Examiner* — David Walczak

(74) *Attorney, Agent, or Firm* — Michelle Arney

(57) ABSTRACT

An applicator bottle design which allows significantly less fluid to be wasted than previous designs. The design includes a reservoir or indentation for the applicator while the top of the bottle is screwed on. When the bottle is unscrewed, or in use, the applicator can reach more fluid in the bottle so that less fluid is wasted than with conventional applicator bottles.

6 Claims, 8 Drawing Sheets

BOTTLE WITH APPLICATOR

RELATED APPLICATIONS

This application is a continuation of U.S. patent application Ser. No. 13/763,237 filed Feb. 8, 2013, now U.S. Pat. No. 8,783,990, the disclosure of which is incorporated herein by reference for all purposes.

FIELD OF THE INVENTION

The present invention relates to a container used to store fluids.

BACKGROUND

There are several different kinds of bottles used to store fluids. Some bottles come with an applicator brush, sponge or other applicator to apply the fluid. For example nail polish bottles, makeup bottles, paint bottles etc. If the bottle is a screw-top bottle, and the applicator is used more than once in a session, it can be difficult to use all of the fluid because the applicator may not reach the bottom of the bottle. For example, when using nail polish, the bottle is generally shaken and then opened by unscrewing the top. The most common design includes a brush applicator attached to the inside of the top. Once the top is unscrewed, the brush no longer reaches the bottom of the bottle. Usually polish is applied to multiple fingers before the top is screwed back on which means that the brush applicator must be repeatedly dipped back into the fluid in the bottle without screwing the cap back on. The result is that during application, the applicator cannot reach the fluid in the bottom portion of the bottle. A significant volume of fluid may be wasted as a result.

SUMMARY

The present invention provides a solution which overcomes the shortcomings of prior devices and methods. The present invention is a bottle design which allows significantly less fluid to be wasted in an applicator bottle. The design allows for a reservoir or indentation for the applicator while the top of the bottle is screwed on. The reservoir is small enough that less fluid is wasted. In other words, when the bottle is unscrewed, or in use, the applicator can reach the majority of the fluid in the bottle so that the fluid is not wasted.

DETAILED DESCRIPTION

Figure 1B:
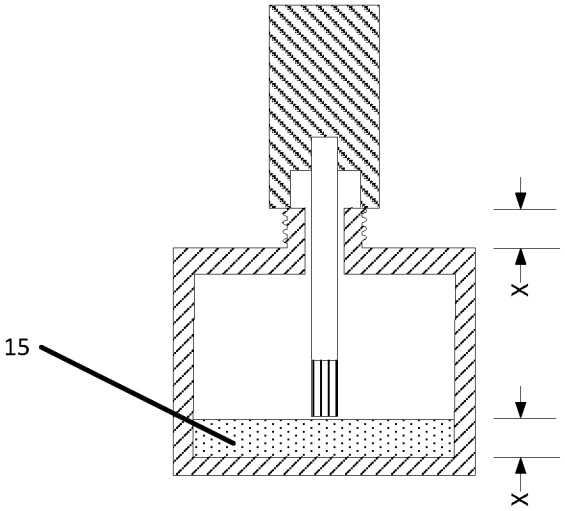
FIGS. 1A-1B show applicator bottles currently available.
Figure 1A:
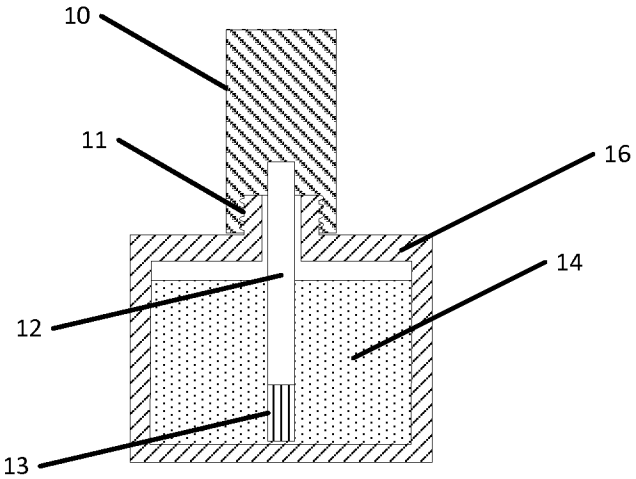
FIG 1A PRIOR ART

FIG. 1A depicts an applicator bottle, for example, a bottle of nail polish, that is currently available. The bottle is in the closed position. The bottle 16 has threads 11 which fit the threads in the handle 10 of the bottle. An applicator is made up of a shaft 12 which is attached to brush 13. The handle 10 is attached to the applicator at shaft 12. The bottle contains a fluid 14 which can be applied using the applicator. When the bottle is in the closed position, the brush 13 is near the bottom of the bottle.

FIG. 1B depicts the applicator in FIG. 1A when it is in the open position. Note that the top 10 is now unscrewed from the threads 11 in the bottle, 16. When the top is unscrewed, the top is distance X higher, with respect to the bottle, than it was when the bottle was in the closed position. As a result, the brush 13 of the applicator is also approximately distance X from the bottom of the bottle. In the open position, fluid 15 is not able to be reached by the applicator. Since fluid 15 cannot be reached by the applicator, it cannot be used and is therefore wasted.

Figure 2B:
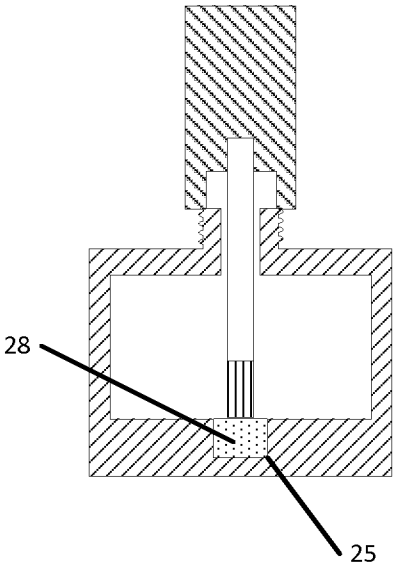
FIGS. 2A-2B show an embodiment of the invention.
Figure 2A:
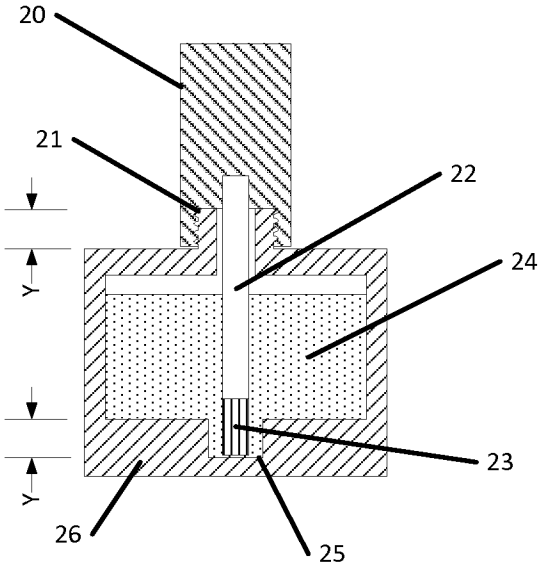

FIGS. 2A and 2B show an embodiment of the invention. In this embodiment, the container or bottle 26 has indentation 25 which is large enough to fit the applicator tip 23 when the bottle is in the closed position. The bottle 26 has an attachment mechanism, such as threads 21 which fit the attachment mechanism, such as threads in the top, cap, or handle 20 of the bottle. The applicator is made up of a shaft 22 which is attached to applicator tip 23. The handle 20 is attached to the applicator at shaft 22. The bottle contains a substance or fluid 24 which can be applied using the applicator. When the bottle is in the closed state or position, the applicator tip 23 is near the bottom of the bottle and is at least in part inside reservoir or indentation 25. The depth of indentation 25 is approximately the depth of the threads 21, so that when the bottle is in the open position, the applicator tip is near the top of the indentation.

FIG. 2B shows the bottle of FIG. 2A when it is in the open position. When all the fluid that can be reached with the bottle in the open position is depleted, only fluid 28 remains in indentation 25. The volume of fluid 28 is much less than that of fluid 15 in FIG. 1B and as a result, much less fluid is wasted.

The attachment mechanism may also be a press fit, a snap fit, or another attachment mechanism. The reservoir or indentation at the bottom of the bottle may be of any suitable shape.

In a preferred embodiment, bottle 26 is made of glass or another clear material, applicator tip 23 is a brush, and fluid 24 is fingernail polish. The fingernail polish may be colored so that the indentation fills with the colored polish and is visible to the user. When the bottle is closed, the applicator tip is near the bottom of indentation 25. When the bottle is open, and the threads 21 in handle 20 are in the open position, but just touching each other (as would be the case when somebody is applying fingernail polish from the bottle after it is open), the applicator tip is near the top of the indentation. Note that a user will repeatedly place the applicator back into the bottle to get more polish on the applicator for the next fingernail. The user does not want to screw the handle on each time so will just put the applicator in as far as it will go, as is illustrated in FIG. 2B. As the nail polish is used up, the fluid level will decrease until it essentially only fills the indentation at the bottom of the bottle. At this point, the user will likely start a new bottle and the polish in the indentation will be discarded. However, the volume of polish discarded in the indentation is much less than the volume discarded in current nail polish bottles as depicted in FIG. 1B.

Figure 3B:
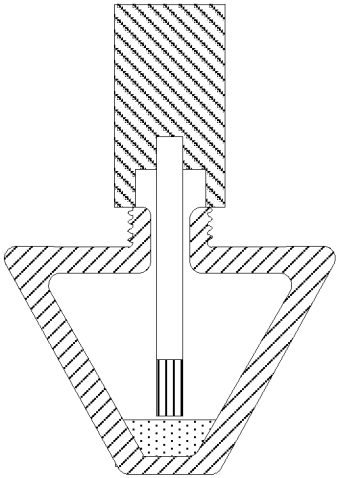
FIGS. 3A-3B show another embodiment of the invention.
Figure 3A:
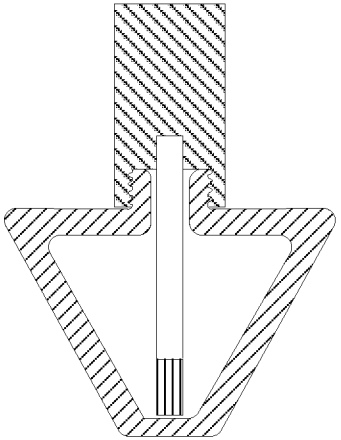

FIGS. 3A and 3B show another embodiment of the invention. In this embodiment, the bottle does not have a discreet indentation, but instead narrows near the bottom. The result is similar, that less fluid is wasted than if the bottle had a wide base.

Figure 4B:
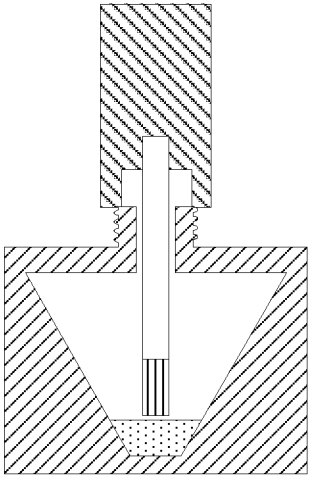
FIGS. 4A-4B show another embodiment of the invention.
Figure 4A:
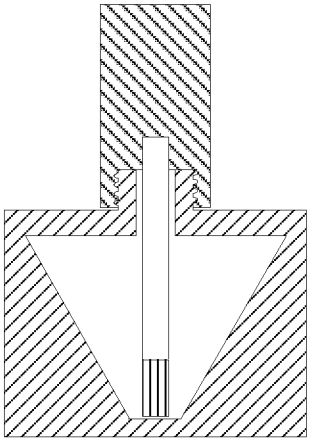
Figures 5A, 5B, 5C, 5D, 5E:
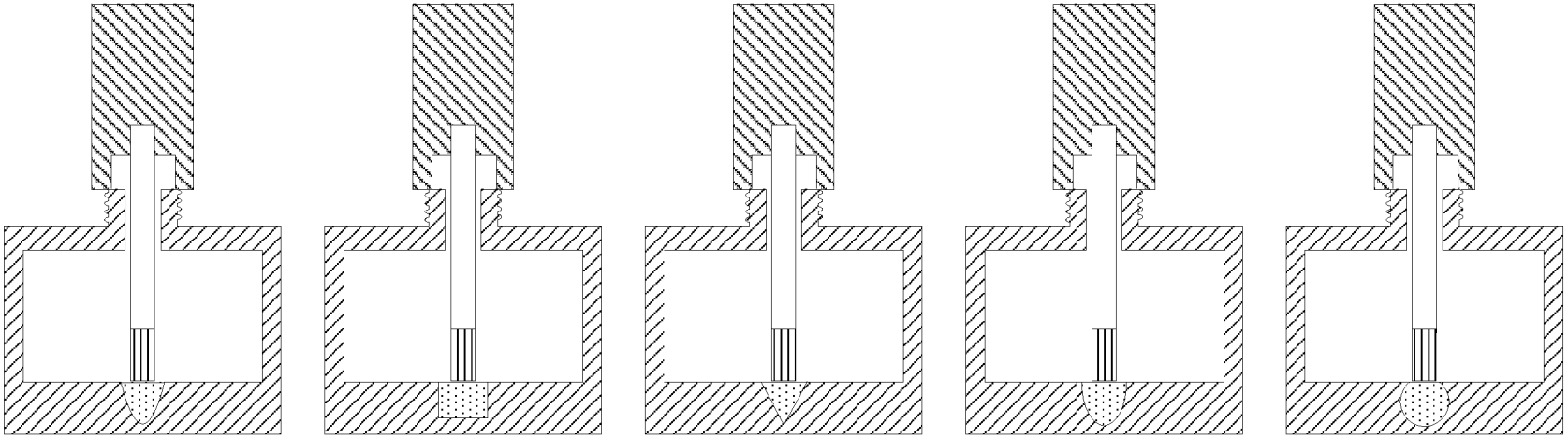
FIGS. 5A-5E show details of possible reservoir shapes.

FIGS. 4A and 4B show another embodiment of the invention. This embodiment is similar to that shown in FIGS. 3A and 3B, except that in this embodiment, the material of the bottle is thicker near the bottom of the bottle. This allows for a wider base of the bottle and less likelihood of tipping over.

FIGS. 5A-5E show some possible variations of the embodiment shown in FIGS. 2A and 2B. These variations show some of the different shape indentations which are possible. Other shapes and configurations are also possible.

Figures 6A, 6B, 6C, 6D, 6E:
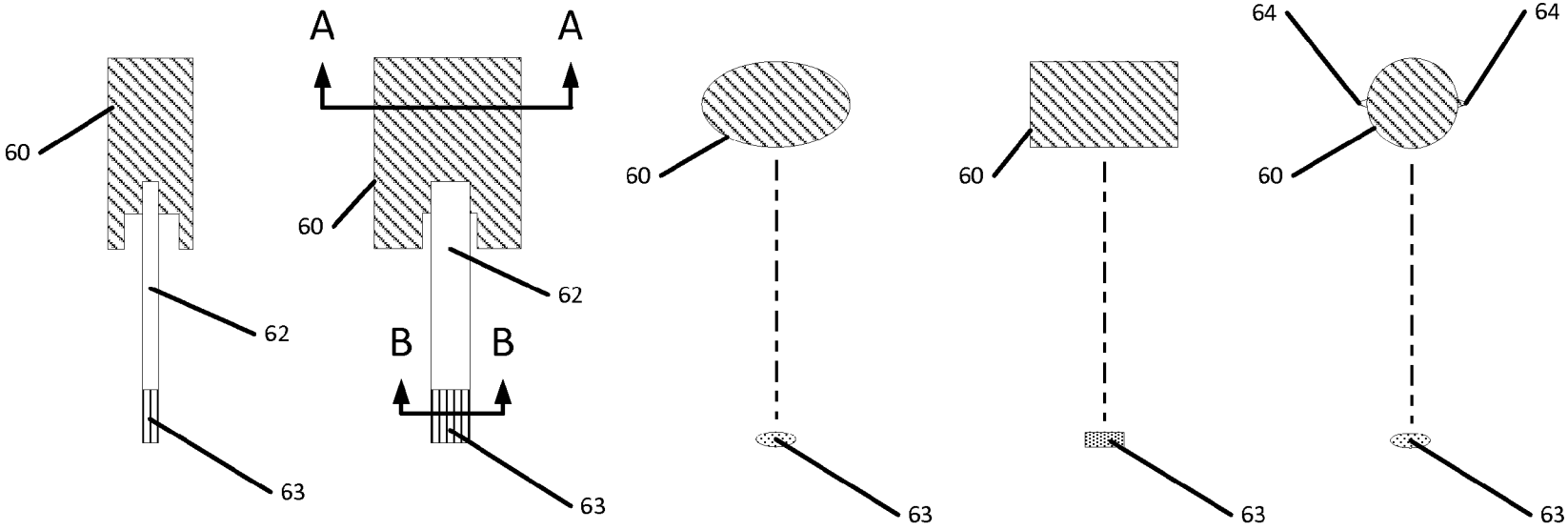
FIGS. 6A-6E show details of the handle, applicator and applicator tip of some possible embodiments of the invention.

FIGS. 6A-6E show another embodiment of the invention. In this embodiment, applicator tip 63 is wider than it is long. This is to allow the applicator to apply more or less of the fluid depending on how the brush is used. This allows more control to the user of the applicator in applying the fluid. The applicator shaft 62 may also be wider than it is long. In addition, the handle 60 of the applicator may also be wider than it is long, so that it is clear which way the applicator tip is oriented while it is still in the bottle. The handle may also or alternatively have tactile indicators 64 which indicate the orientation of the applicator tip 63. The handle may also have visible indicators, such as a stripe, or dot, to show the orientation of the applicator tip. FIG. 6C shows the cross section of the handle, and the bottom of the applicator tip at A and B of FIG. 6B respectively. FIGS. 6D and 6E show alternative embodiments.

Figure 7A:
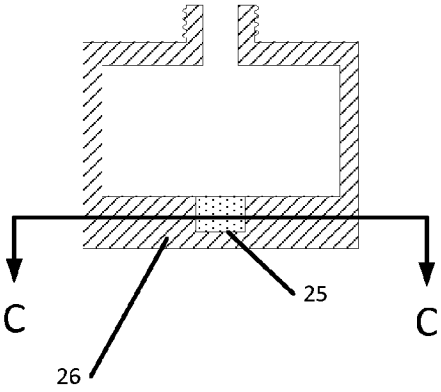
FIGS. 7A-7F show cross sectional areas of the bottom portion of the bottle.
Figure 7B:
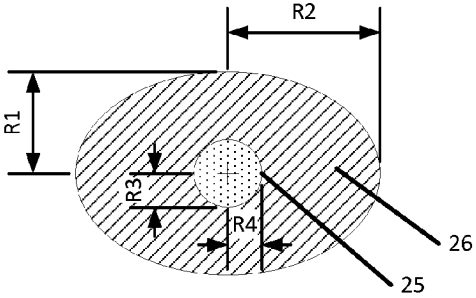
Figure 7C:
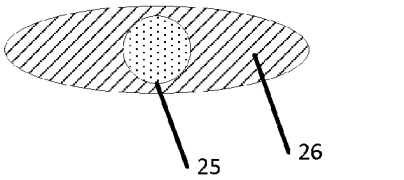
Figure 7D:
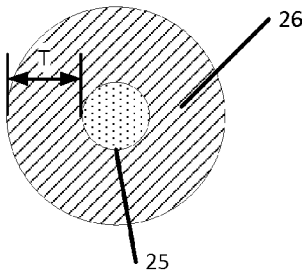

FIGS. 7A-7B show cross sections of various embodiments of the bottom portion of the applicator bottle where the reservoir resides. FIG. 7A shows just the bottle portion of FIG. 2B. Reservoir 25 and bottle 26 are shown. FIGS. 7B-7F show the cross section C of the bottle and reservoir shown in FIG. 7A. Note that the cross section of the bottom portion of the bottle and the cross section of the reservoir are in the same plane in these diagrams. The wall thickness of the bottom portion of the bottle is shown as T in FIG. 7D. Various shapes are shown and many more could be used. The cross section of the bottom portion of the bottle and the cross section of the reservoir each have an area. In one embodiment, the cross sectional area of the reservoir is less than half that of the bottom of the bottle. In another embodiment, the cross sectional area of the reservoir is less than ¼ that of the bottom of the bottle. In another embodiment, the cross sectional area of the reservoir is less than ⅛ that of the bottom of the bottle. In another embodiment, the cross sectional area of the reservoir is less than 1/10 that of the bottom of the bottle. In another embodiment, the cross sectional area of the reservoir is less than 1/20 that of the bottom of the bottle. In another embodiment, the cross sectional area of the reservoir is less than 1/50 that of the bottom of the bottle. In another embodiment, the cross sectional area of the reservoir is less than 1/100 that of the bottom of the bottle. However, other ratios can be used, as long as the cross sectional area of the reservoir is less than the cross sectional area of the bottom of the bottle.

For example, if the cross sectional shape of the bottom portion of the bottle or the reservoir is an ellipse, the cross sectional area would be calculated using the formula:

$$\text{Area}=\pi\times R1\times R2$$

or $$\text{Area}=\pi\times R3\times R4$$

where R1 and R2, or R3 and R4, represent the short and long radii of the ellipse (see FIG. 7B). If the short and long radii are equal, the shape is a circle and the area is calculated using the formula:

$$\text{Area}=\pi\times R^2$$

where R is the radius of the circle.

Figure 7E:
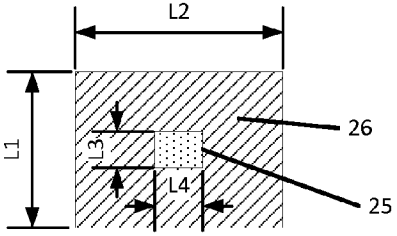
Figure 7F:
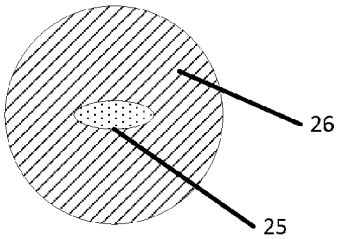

In another example, the cross sectional shape of the bottom of the bottle or the reservoir may be a rectangle or square. In this embodiment, the cross sectional area would be calculated using the formula:

$$\text{Area}=L1\times L2$$

or $$\text{Area}=L3\times L4$$

where L1 and L2, or L3 and L4, represent the short and long sides of a rectangle (see FIG. 7E). If the short and long sides are equal, the shape is a square and the area is calculated using the formula:

$$\text{Area}=L^2$$

It is clear that any shape could be used for both the bottle and the reservoir. The examples in FIGS. 7B-7F are only examples.

Figure 8B:
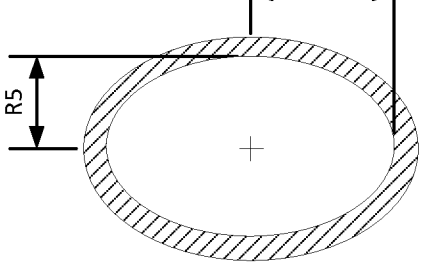
FIGS. 8A-8C show cross sectional areas of the body of the bottle.
Figure 8A:
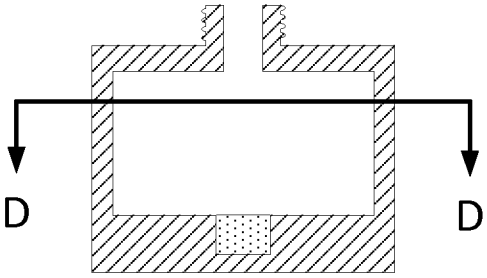
Figure 8C:
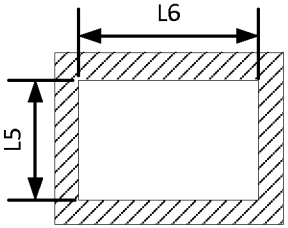

FIGS. 8A-8C show cross sections of an embodiment of the body portion of the applicator bottle. FIG. 8A shows just the bottle portion of FIG. 2B. FIG. 8B shows the cross section D of the body of the bottle shown in FIG. 8A. Note that the body portion of the bottle does not contain the reservoir Many shapes could be used, including an ellipse, circle, rectangle or any other shape. The cross section of the body portion of the bottle has an inside and outside area. In a preferred embodiment, the cross sectional area of the reservoir is less than half that of the inside cross section of the body of the bottle. In another preferred embodiment, the cross sectional area of the reservoir is less than ¼ of the inside cross section of the body of the bottle. In another preferred embodiment, the cross sectional area of the reservoir is less than ⅛ of the inside cross section of the body of the bottle. However, other ratios can be used, as long as the cross sectional area of the reservoir is less than the inside cross sectional area of the body of the bottle.

For example, if the inside cross sectional shape of the body portion is an ellipse, the cross sectional area would be calculated using the formula:

$$\text{Area}=\pi\times R5\times R6$$

where R5 and R6 represent the short and long radii of the ellipse (see FIG. 8B). If the short and long radii are equal, the shape is a circle and the area is calculated using the formula:

$$\text{Area}=\pi\times R^2$$

where R is the radius of the circle.

In another example, the inside cross sectional shape of the body of the bottle may be a rectangle or square. In this embodiment, the cross sectional area would be calculated using the formula:

$$\text{Area}=L5\times L6$$

where L5 and L6 represent the short and long sides of a rectangle (see FIG. 8C). If the short and long sides are equal, the shape is a square and the area is calculated using the formula:

$$\text{Area}=L^2$$

It is clear that any shape could be used for both the body of the bottle. The examples in FIGS. 8A-8C are only examples.

Note also in the figures that the wall thickness of the body of the bottle is substantially thinner than the wall thickness of the bottom portion of the bottle (where the reservoir resides). In one embodiment the ratio of the wall thickness of the body of the bottle to the wall thickness of the bottom portion of the bottle is 0.5 or less. In another embodiment the ratio of the wall thickness of the body of the bottle to the wall thickness of the bottom portion of the bottle is 0.4 or less. In another embodiment the ratio of the wall thickness of the body of the bottle to the wall thickness of the bottom portion of the bottle is 0.3 or less. In another embodiment the ratio of the wall thickness of the body of the bottle to the wall thickness of the bottom portion of the bottle is 0.2 or less. In another embodiment the ratio of the wall thickness of the body of the bottle to the wall thickness of the bottom portion of the bottle is 0.1 or less. In another embodiment the ratio of the wall thickness of the body of the bottle to the wall thickness of the bottom portion of the bottle is 0.05 or less.

In one embodiment the ratio of the average wall thickness of the body of the bottle to the average wall thickness of the bottom portion of the bottle is 0.5 or less. In another embodiment the ratio of the average wall thickness of the body of the bottle to the average wall thickness of the bottom portion of the bottle is 0.4 or less. In another embodiment the ratio of the average wall thickness of the body of the bottle to the average wall thickness of the bottom portion of the bottle is 0.3 or less. In another embodiment the ratio of the average wall thickness of the body of the bottle to the average wall thickness of the bottom portion of the bottle is 0.2 or less. In another embodiment the ratio of the average wall thickness of the body of the bottle to the average wall thickness of the bottom portion of the bottle is 0.1 or less. In another embodiment the ratio of the average wall thickness of the body of the bottle to the average wall thickness of the bottom portion of the bottle is 0.05 or less.

In terms of materials, the bottle may be made out of either a clear or opaque or semi-opaque material. It may be glass, polymer, metal or other suitable materials. The handle and shaft are most likely made out of polymer, but may also be made out of other suitable materials. The applicator tip may be a brush, sponge, spiral brush, plastic, hollow tube, as in a pump, or other configurations. The applicator tip may be made out of polymer or other suitable materials. The fluid inside the bottle may be nail polish, liqueur, lotion, mascara, makeup, cosmetics, wax, or other fluids and may be colored, opaque, semi-opaque or clear. The bottle top may attach to the bottle via mechanisms other than threads, such as a press fit, a snap fit, etc.

It is evident from the examples presented above that the invention is not limited to the examples mentioned in this text but can be implemented in many other different embodiments within the scope of the inventive idea.

The invention claimed is:

1. An applicator bottle comprising:

a bottle with a bottom portion and a top portion where the top portion has an opening incorporated therein and the bottom portion has an upper surface and a lower surface;

where the bottom portion of the bottle has a first cross sectional area;

an applicator with an applicator tip attached thereto;

a top with a bottle attachment mechanism incorporated therewithin;

where the top is attached to the applicator;

where the applicator bottle has a closed state where the top is sealably attached with the bottle attachment mechanism to the opening in the top portion of the bottle and the applicator is inside the bottle;

where the bottom portion of the bottle incorporates an indentation with a top and with a second cross sectional area in which the applicator tip resides when the applicator bottle is in the closed state;

where the upper surface of the bottom portion of the bottle is essentially parallel to the lower surface of the bottom portion of the bottle;

where the bottle attachment mechanism comprises threads; and where the applicator bottle has an open state where the top is not sealably attached to the opening in the top portion of the bottle and the applicator tip is near the top of the indentation.

2. The applicator bottle of claim 1 where;

the second cross sectional area is less than the first cross sectional area.

3. The applicator bottle of claim 1 where;

the second cross sectional area is less than half of the first cross sectional area.

4. An applicator bottle comprising:

a bottle with a bottom portion and a top portion where the top portion has an opening incorporated therein;

where the bottom portion of the bottle has a first cross sectional area;

an applicator with an applicator tip attached thereto;

a top with a bottle attachment mechanism incorporated therewithin;

where the top is attached to the applicator;

where the applicator bottle has a closed state where the top is sealably attached with the bottle attachment mechanism to the opening in the top portion of the bottle and the applicator is inside the bottle;

where the bottom portion of the bottle incorporates a discreet indentation with a top and with a second cross sectional area in which the applicator tip resides when the applicator bottle is in the closed state;

where the bottle attachment mechanism comprises threads; and where the applicator bottle has an open state where the top is not sealably attached to the opening in the top portion of the bottle and the applicator tip is near the top of the indentation.

5. The applicator bottle of claim 4 where;

the second cross sectional area is less than the first cross sectional area.

6. The applicator bottle of claim 4 where;

the second cross sectional area is less than half of the first cross sectional area.

* * * * *